United States Patent [19]

Martin

[11] 4,445,454

[45] May 1, 1984

[54] TEMPERATURE SENSOR

[75] Inventor: Henry W. Martin, Houston, Tex.

[73] Assignee: T. F. Hudgins & Associates, Inc., Houston, Tex.

[21] Appl. No.: 348,594

[22] Filed: Feb. 12, 1982

[51] Int. Cl.[3] ..... G08B 17/00

[52] U.S. Cl. ..... 116/106; 116/112

[58] Field of Search ..... 116/106, 217, 218, 221; 73/708, 714; 374/160

[56] References Cited

U.S. PATENT DOCUMENTS

| | | | |
|---|---|---|---|
| 1,723,902 | 8/1928 | Wainwright | 116/218 |
| 2,187,958 | 1/1940 | Vigne et al. | 116/106 |
| 2,424,203 | 9/1949 | Wrightman et al. | 116/106 |
| 3,192,890 | 7/1965 | Smith | 116/106 |
| 3,603,280 | 9/1977 | Zahuranec | 116/218 |
| 3,667,419 | 6/1972 | Sullivan | 116/106 |
| 4,154,189 | 5/1979 | Gallagher et al. | 116/106 |

*Primary Examiner*—Gerald Goldberg
*Assistant Examiner*—Hezron Williams

[57] ABSTRACT

A fusible solder temperature sensor adapted for use with a trapped fluid pressure header alarm system. The sensor includes an insulating plastic fitting having threads at one end and a bore therethrough for connection to and fluid communication with the header system. A brass tube is connected at one end to the other end of the plastic fitting for fluid communication therewith. The other end of the brass tube is closed by a bronze closure disc attached thereto by fusible solder responsive to ambient air or other gas temperature above a determined level. When the ambient temperature reaches the determined level, the solder melts, releasing the closure disc from the tube, thereby releasing pressure from the alarm system to generate an alarm signal or the like.

2 Claims, 2 Drawing Figures fig.1
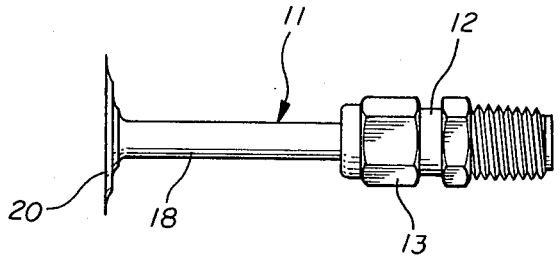
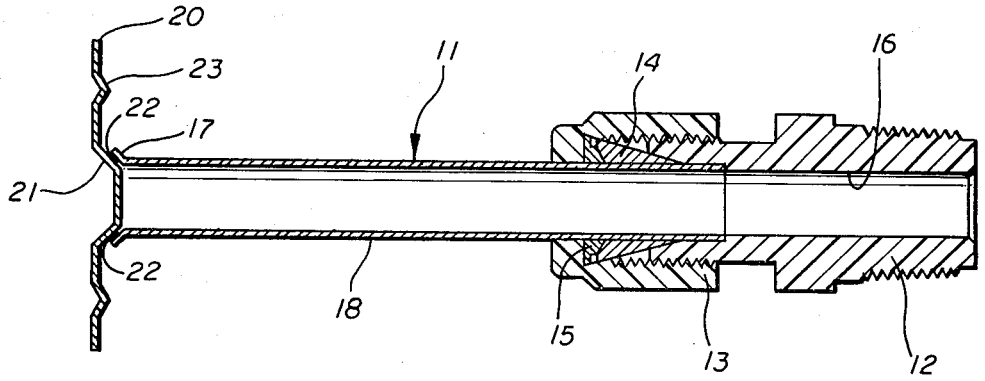
fig.2

TEMPERATURE SENSOR

BACKGROUND OF THE INVENTION

A. Field of the Invention

This invention relates to a temperature sensor which is adapted for use in fluid pressure systems such as pressurized air systems for generating alarm signals in response to increase in ambient air or other gas temperature above a determined level.

B. Description of the Prior Art

It is desirable to have temperature sensors of the foregoing type which have a quick response time to sudden increases in temperature which would indicate a fire. In certain instances it is desirable to have a fluid-actuated system rather than an electrical system in certain installations. However, the fluid system, to be successful, must approach the response of electrical or electronic-type systems.

Heretofore, fusible metal temperature sensors have been used consisting of a short brass pipe plug with a small hole therethrough which is filled with a controlled melting-point solder. Plugs of this type are normally used with temperature-sensing systems often used for fire detection, such systems consisting of a long tube header closed at the far end and connected to a source of fluid pressure on the near end. Spaced along the header are a series of T-fittings with one of the plug sensors screwed into the branch of each T to form a pressure-tight system. Sufficient heat near any one of the sensor plugs will melt the solder and release fluid pressure, the loss of which is used to trigger an alarm or other action. Systems of this type have the drawback of being relatively slow in response time to the sudden increase in temperature which would indicate a fire. Accordingly, there has developed a need for a fire detection system which can be used in certain installations where it is undesirable or impractical to have an electrical or electronic system, yet which will respond with equal quickness to such systems.

SUMMARY OF THE INVENTION

It is therefore an object of this invention to provide a temperature sensor which overcomes the problems of the prior art and which meets the special needs which arise from time to time, as discussed above. Briefly stated, this invention comprises a fusible solder temperature sensor which is adapted for use with a trapped fluid pressure header alarm system. It includes an insulating plastic fitting having threaded means at one end thereof and a bore therethrough for connection through and fluid communication with the header system. A tube of a suitable material such as brass having thin walls is connected at one end to the other end of the plastic fitting for fluid communication therewith. A thin closure disc made of a material such as bronze is attached to and closes the other end of the brass tube, with the disc being attached by means of a fusible solder responsive to ambient temperature above a determined level. Hence, the solder will melt when the sensor is subjected to ambient air or gas temperature above the determined level to thereby release the disc from the tube, causing release of the trapped pressure such as air pressure in the header system to thereby generate a heat alarm signal. The plastic forming the fitting may be of nylon or the like which provides an insulation barrier. It is to be understood that the closure disc has a surface area substantially larger than the cross-sectional area of the end of the tube to which it is attached. Preferably the attaching end of the tube has a radially outwardly flared end portion and the disc has a frustoconical ring portion for mating with the flared end portion, with the solder being interposed between the flared portion and the frustoconical ring portion. Preferably the brass tube is connected to the plastic fitting by means of a mechanical gripping and sealing means which may be of plastic material, such as nylon.

BRIEF DESCRIPTION OF THE DRAWING

FIG. 1 is a side elevation view of one preferred embodiment of the present invention.

FIG. 2 is a somewhat enlarged central cross-sectional view of the sensor shown in FIG. 1.

DESCRIPTION OF THE PREFERRED EMBODIMENT

The temperature sensor of this invention is generally designated by the numeral 11 and is comprised of a double-threaded fitting 12, the right end of which as viewed in FIG. 2 is adapted for threading engagement with a pressurized header system of the type for generating an alarm in response to release of pressure. Fitting 12 is provided with an axial bore 16 for fluid communication with said header system.

The opposite end of fitting 12 is provided with external threads arranged for receiving thrust ring 13 in threaded engagement therewith. The aforesaid end of fitting 12 is also tapered so as to receive tapered annular ferrule 14 for axial sliding engagement therewith. Also mounted between ferrule 14 and the base of thrust ring 13 is an annular seal 15. It is to be understood that fitting 12, thrust ring 13, ferrule 14 and seal 15 may all be of insulating plastic material such as nylon or the like. In addition, fitting 12 and thrust ring 13 may have enlarged portions on the exterior thereof for forming wrench fitting whereby torque may be applied thereto. Upon application of such torque pressure, thrust ring 13 urges seal 15 and ferrule 14 into sealing and engaging relationship with a thin-walled brass tube 18 which is in fluid communication with bore 16 of fitting 12.

The opposite end of tube 18 is flared radially outwardly to provide flared end 17. Tube 18 is closed by having mounted across the end thereof a relatively thin-walled brass disc 20 having a substantially larger surface area than the cross-sectional area of the end of tube 18. Disc 20 has a frustoconical portion 21 which generally mates with flared end 17 and is held thereto by the deposition of a thin annular layer 22 of fusible solder responsive to ambient temperature above a determined level, such solder being well known to those skilled in the art. Disc 20 also has an embossed circular ridge 23 around its outer edge to provide stiffness in the thin material. Tube 18 and disc 20 are made preferably of a material having a combination of high thermal conductivity, corrosion resistance, relative high strength to mass, ease of forming, and a bonding affinity for the fusible material forming layer 22. Metals including the brasses and bronzes are examples of such material.

In operation, sensor 11 is threadably engaged in a suitable pressure header alarm system having pressurized fluid such as air therein which upon release of pressure will actuate an alarm in conventional manner. When sensor 11 is subjected to ambient air or other gas temperature above the melting point of solder layer 22, disc 20 and tube 18 act as a heat collector and transmit the heat to the solder layer 22 as does tube 18. At the melt point of solder layer 22, disc 20 is released, thereby releasing the air pressure inside sensor 11, thereby actuating the alarm system described above.

This invention has the great advantage of having a very short response time compared with prior art devices of this type and which can be used with a pneumatic alarm system. The features of this invention provide a multiple reduction in response time as compared with prior art devices. This reduced response time is believed to be due to the various features embodied in the invention such as increased surface area represented by disc 20 relative to the total mass of sensor 11. In addition, the particular configuration of tube 18 and disc 20 greatly reduces the volume of solder which is required while still maintaining the strength and ease of assembly. Stated otherwise, there is provided increased bond area by the flared tube portion 17 and the frustoconical portion 1. Reduced solder volume reduces not only the mass to be heated but also the heat of fusion required to melt the solder. It is also believed that there is significant advantage in the insulator effect provided by nylon fitting 12 and related ferrule 14 and seal 15. With this arrangement, the heat added to the sensor which is absorbed by disc 20 is not drained away by the mass of the header as readily as with prior embodiments.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In a fusible solder temperature sensor adapted for use with a trapped fluid pressure header alarm system for sensing temperature in a gaseous atmosphere, comprising:

a thermally insulating plastic fitting having thread means at one end thereof and a bore therethrough for connection to and in fluid communication with said header system;

a thin-walled metal tube connected at one end to the other end of said insulating plastic fitting for fluid communication therewith, and said tube having a radially outwardly flared portion at the other end thereof;

a metal closure disc releasably attached to and closing said other end of said tube, said closure disc having a surface area substantially larger than the cross-section area of said tube, and said disc having a frustoconical portion matching said flared end portion of said tube; and a thin frustoconical layer of fusible solder spaced between said flared end portion of said tube and said frustoconical portion of said disc for releasably attaching said disc to said tube, said solder being responsive to ambient temperature above a predetermined level;

whereby said disc and said tube collect and transmit heat to thereby melt said solder when subjected to ambient temperature above said determined level to thereby release said closure disc from said tube causing release of trapped pressure in said header system to thereby generate a heat alarm signal.

2. The invention as claimed in claim 1 wherein:

said tube is connected to said fitting by plastic mechanical gripping and sealing means; and said disc has an embossed annular ridge spaced radially outwardly of said frustoconical portion for providing stiffness thereto.

* * * * *